US011076257B1

(12) United States Patent
Sunder et al.

(10) Patent No.: US 11,076,257 B1
(45) Date of Patent: Jul. 27, 2021

(54) CONVERTING AMBISONIC AUDIO TO BINAURAL AUDIO

(71) Applicant: EmbodyVR, Inc., San Mateo, CA (US)

(72) Inventors: Kaushik Sunder, Mountain View, CA (US); Saarish Kareer, Sunnyvale, CA (US)

(73) Assignee: EmbodyVR, Inc., San Mateo, CA (US)

( * ) Notice: Subject to any disclaimer, the term of this patent is extended or adjusted under 35 U.S.C. 154(b) by 0 days.

(21) Appl. No.: 16/793,877

(22) Filed: Feb. 18, 2020

Related U.S. Application Data

(60) Provisional application No. 62/861,738, filed on Jun. 14, 2019.

(51) Int. Cl.
*H04S 7/00* (2006.01)
*H04S 3/02* (2006.01)

(52) U.S. Cl.
CPC ..... *H04S 7/304* (2013.01); *H04S 3/02* (2013.01); *H04S 7/305* (2013.01); *H04S 2420/01* (2013.01); *H04S 2420/11* (2013.01)

(58) Field of Classification Search
CPC . H04S 7/304; H04S 7/305; H04S 5/00; H04S 3/02; H04S 3/00; H04S 2420/01; H04S 2420/11; H04S 2400/01; H04S 1/002; H04S 1/00; H04S 1/005; H04R 3/12; H04R 5/04; H04R 5/033; H04R 5/02; H04R 2205/022
USPC ..... 381/1, 17, 309, 300
See application file for complete search history.

(56) References Cited

U.S. PATENT DOCUMENTS

| | | | | |
|---|---|---|---|---|
| 9,510,127 | B2 * | 11/2016 | Squires | H04S 7/306 |
| 9,560,465 | B2 | 1/2017 | Stein et al. | |
| 9,621,991 | B2 | 4/2017 | Virolainen et al. | |
| 10,009,704 | B1 * | 6/2018 | Allen | H04S 3/004 |
| 10,362,431 | B2 * | 7/2019 | Breebaart | H04S 3/008 |
| 10,492,018 | B1 * | 11/2019 | Allen | H04S 3/008 |
| 2006/0062409 | A1 * | 3/2006 | Sferrazza | H04S 3/00 381/309 |

(Continued)

FOREIGN PATENT DOCUMENTS

KR 20160102683 A 8/2016

OTHER PUBLICATIONS

PCT Application Serial No. PCT/US2019/061706, International Search Report, dated Mar. 6, 2020, 3 pages.

(Continued)

*Primary Examiner* — Ahmad F. Matar
*Assistant Examiner* — Sabrina Diaz
(74) *Attorney, Agent, or Firm* — Gilliam IP PLLC

(57) ABSTRACT

Ambisonic audio is converted to binaural audio based on head related impulse responses (HRIRs) associated with sound sources located symmetric with respect to a head of a listener. The HRIRs associated with sound sources located symmetric with respect to the head of the listener are mapped to HRIR pairs associated with sound sources located on one side of the head of the listener based on the symmetry of the sound source locations. A sequence of HRIRs based on the mapped left HRIRs or a sequence of HRIRs based on the mapped right HRIRs are input into a spherical harmonics converter which outputs respective left spherical harmonics or right spherical harmonics. Ambisonic audio is binauralized based on the left spherical harmonics and the right spherical harmonics.

18 Claims, 7 Drawing Sheets

(56) References Cited

U.S. PATENT DOCUMENTS

| | | | | |
|---|---|---|---|---|
| 2013/0064375 | A1* | 3/2013 | Atkins | H04S 7/301 381/17 |
| 2013/0170679 | A1* | 7/2013 | Nystrom | H04R 5/033 381/311 |
| 2013/0202129 | A1 | 8/2013 | Kraemer et al. | |
| 2014/0355794 | A1* | 12/2014 | Morrell | G10L 19/008 381/303 |
| 2016/0029144 | A1* | 1/2016 | Cartwright | H04S 7/30 381/310 |
| 2016/0100268 | A1 | 4/2016 | Stein et al. | |
| 2016/0241980 | A1 | 8/2016 | Najaf-Zadeh et al. | |
| 2017/0245082 | A1* | 8/2017 | Boland | H04S 7/306 |
| 2018/0295463 | A1 | 10/2018 | Eronen et al. | |
| 2019/0069110 | A1* | 2/2019 | Gorzel | H04S 5/005 |
| 2019/0200159 | A1* | 6/2019 | Park | G10L 21/02 |
| 2019/0215637 | A1* | 7/2019 | Lee | H04S 7/304 |
| 2019/0289416 | A1 | 9/2019 | York et al. | |
| 2020/0245092 | A1 | 7/2020 | Badhwar et al. | |

OTHER PUBLICATIONS

PCT Application Serial No. PCT/US2019/061706, International Written Opinion, dated Mar. 6, 2020, 5 pages.

Gorzel, et al., "Efficient Encoding and Decoding of Binaural Sound with Resonance Audio", Audio Engineering Society, Conference Paper 68, 2019, 12 pages.

Kares, et al., "Streaming Immersive Audio Content", Audio Engineering Society Conference Paper, 2016, 8 pages.

Mayumi, "New content form created by avexr studio", [online] retrieved on Jun. 14, 2019 from <https://pro.miroc.co.jp/headline/avexr-studio/> (machine translated), 2018, 24 pages.

Narbutt, et al., "Streaming VR for Immersion: Quality Aspects of Compressed Spatial Audio", Dublin Institute of Technology Conference Papers, 2017, 7 pages.

Politis, et al., "JSAmbisonics: A Web Audio Library for Interactive Spatial Sound Processing on the web", 2016, 9 pages.

U.S. Appl. No. 16/685,305; Non-Final Office Action; dated Nov. 27, 2020, 8 pages.

* cited by examiner

400

| Ambisonic Channel Number - Y(n,m) 402 | Symmetric Axes 404 | Anti-symmetric Axis 406 | Graphical Illustration 408 |
|---|---|---|---|
| 0 - Y(0,0) | Front - Back<br>Left - Right<br>Up - Down | None |  |
| 1 - Y(1,-1) | Front - Back<br>Up - Down | Left - Right |  |
| 2 - Y(1,0) | Front - Back<br>Left - Right | Up - Down |  |
| 3 - Y(1,1) | Left - Right<br>Up - Down | Front - Back |  |

CONVERTING AMBISONIC AUDIO TO BINAURAL AUDIO

RELATED DISCLOSURES

This disclosure claims the benefit of priority under 35 U.S.C. § 119(e) of U.S. Provisional Application No. 62/861,738 filed Jun. 14, 2019 entitled "Efficient ambisonic encoding and binaural decoding involving asymmetry", the contents of which is herein incorporated by reference in its entirety.

FIELD OF DISCLOSURE

This disclosure relates to consumer goods and, more particularly, to binaural decoding of ambisonic audio to binaural audio for playback on a personal audio delivery device such as headphones, hearables, earbuds, hearing aids or other ear accessories.

BACKGROUND

Spatial audio such as ambisonic audio is a type of immersive audio which provides a listener with a spatially aware sound experience. Sound is perceived in a three-dimensional space around the listener.

Ambisonic audio represents sound as a full sphere sound field where a first audio signal carries amplitude information for the sound field, while the other audio signals indicate directionality through phase relationships between each other. The ambisonic audio is further characterized by an order. First order ambisonic audio (FOA) is sound represented as an omnidirectional gain and three-dimensional components: forward/backwards, left/right, and up/down. Higher order ambisonic (HOA) is sound represented by an omnidirectional gain and more than three three-dimensional components to significantly improve quality of the spatialized audio. The audio signals associated with ambisonic audio are typically decoded to a playback format such as multi-channel audio which define audio signals for a specific spatial configuration of speakers such as a number of speakers at eye level, a number of subwoofers, and a number of overhead speakers. For example, 5.1.4 multi-channel audio defines the audio signals for a specific layout of 10 speakers positioned in the room which include 5 speakers positioned at eye level, 1 subwoofer, and four overhead speakers, where each speaker receives respective audio signals.

A mobile device such as a smartphone, laptop, or tablet converts ambisonic audio into binaural audio composed of two binaural channels, a left binaural channel and a right binaural channel. The left and right binaural channel are provided to a personal audio delivery device such as headphones, headset, hearables, earbuds, hearing aids or other ear accessories connected to the mobile device for playback of the audio directly into an ear canal of a listener. Because binaural audio played back by the personal audio delivery device does not interact with one or more of a pinna, head, or torso of the listener, the mobile devices uses head related impulse responses (HRIRs) to artificially generate audio cues to spatialize the ambisonic audio converted to the binaural audio. The HRIRs characterize how the sound output by a sound source would be received by a human auditory system based on interaction with the pinna, head, and/or torso of the listener.

BRIEF DESCRIPTION OF THE DRAWINGS

Features, aspects, and advantages of the presently disclosed technology may be better understood with regard to the following description, appended claims, and accompanying drawings where:

Figure 1:
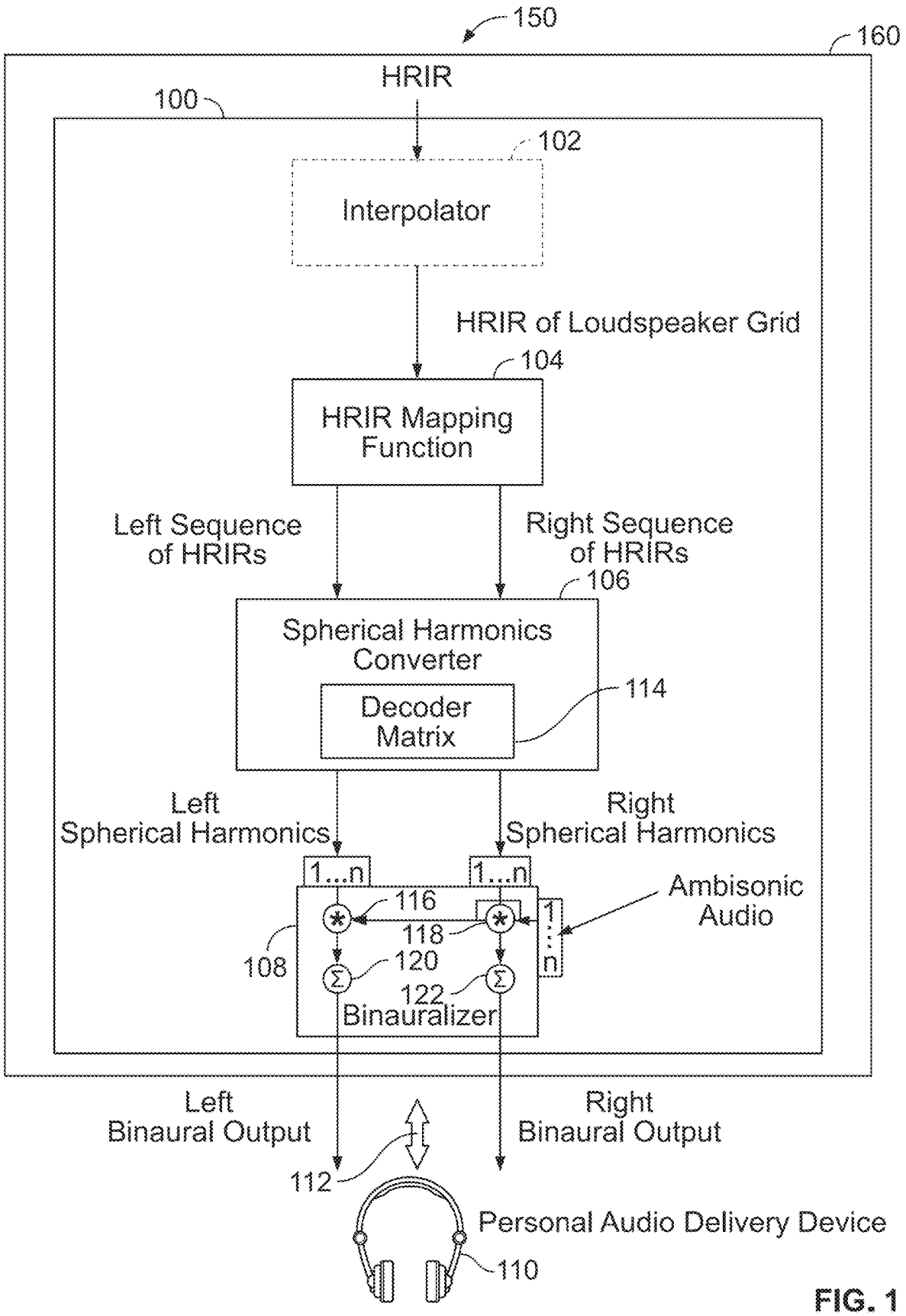
FIG. 1 illustrates an example binaural converter for converting ambisonic audio to binaural audio.

The drawings are for the purpose of illustrating example embodiments, but it is understood that the embodiments are not limited to the arrangements and instrumentality shown in the drawings.

DETAILED DESCRIPTION

The description that follows includes example systems, methods, techniques, and program flows that embody the disclosure. However, it is understood that this disclosure may be practiced without these specific details. For instance, this disclosure describes a process of converting ambisonic audio to binaural audio for playback on a personal audio delivery device such as headphones, a headset, hearables, earbuds, hearing aids or other ear accessories worn by a listener in illustrative examples. Well-known instruction instances, protocols, structures and techniques have not been shown in detail in order not to obfuscate the description.

Overview

Different libraries such as omnitone, JSAmbisonic for web-based applications, ambiX plugin suites for Digital Audio Workstations, Ambisonic Decoder Toolbox for MATLAB, libspatialaudio for C++, and Google Resonance Audio are used to convert ambisonic audio to binaural audio for playback to a listener wearing a personal audio delivery device such as headphones, a headset, hearables, earbuds, hearing aids or other ear accessories. In common with these libraries as well as others is that the libraries have a spherical harmonics converter which receives a sequence of head related impulse responses (HRIRs) associated with sound sources located on one side of a head of a listener. The HRIRs are organized as HRIR pairs, where each HRIR pair includes a left HRIR associated with a left ear and a right HRIR associated with a right ear and the HRIRs of the HRIR pairs are associated with the sound sources located on one side of the head of the listener. The spherical harmonics converter receives a sequence of HRIRs. The spherical harmonics converter converts the sequence of HRIRs into left spherical harmonics associated with a left ear. Based on a symmetry of sound source locations with respect to the head of the listener, the right HRIRs in the sequence of HRIRs is representative of left HRIRs for sound source locations symmetric to the sound source locations on one side of the head of the listener. Right spherical harmonics associated with the right ear is assumed to be the same as the left spherical harmonics and the left spherical harmonics and the right spherical harmonics are used to binauralize the ambisonic audio.

This manner of determining spherical harmonics for the listener to binauralize the ambisonic audio has a negative effect on spatialization because the left HRIRs and right HRIRs are associated with sound source locations on one side of the head of the listener. HRIRs associated with the listener are asymmetric as ears of the listener are asymmetric. HRIRs associated with sound source locations on one side of the head of the listener does not allow for distinguishing between sound in different directions.

Embodiments described herein are directed to converting ambisonic audio to binaural audio based on HRIRs associated with sound sources located symmetric with respect to the head of the listener rather than only HRIRs associated with sound sources on one side of the head of the listener. Further, the spherical harmonics converter determines left spherical harmonics and right spherical harmonics to perform the conversion. The HRIRs associated with sound sources located symmetric with respect to the head of the listener are equivalently mapped to the HRIR pairs associated with sound sources located on one side of the head of the listener based on a symmetry of sound source locations. For example, each HRIR of the left HRIRs are mapped to a corresponding left HRIR or a corresponding right HRIRs of a corresponding HRIR pair of HRIR pairs associated with sound sources located on one side of the head of the listener. As another example, each HRIR of the right HRIRs are mapped to a corresponding left HRIR or a corresponding right HRIRs of a corresponding HRIR pair of HRIR pairs associated with sound sources located on the one side of the head of the listener. A sequence of HRIRs based on the mapped left HRIRs or a sequence of HRIRs based on the mapped right HRIRs are input into the spherical harmonics converter which outputs respective left spherical harmonics or right spherical harmonics. Ambisonic audio is binauralized based on the left spherical harmonics and the right spherical harmonics. The spherical harmonics based on HRIRs associated with sound sources located symmetric with respect to the head of the listener improves spatialization of the binaural audio.

The description that follows includes example systems, apparatuses, and methods that embody aspects of the disclosure. However, it is understood that this disclosure may be practiced without these specific details. In other instances, well-known instruction instances, structures and techniques have not been shown in detail in order not to obfuscate the description.

Example System

FIG. 1 illustrates an example system 150 for converting ambisonic audio to binaural audio. The example system 150 includes a computing device 160, binaural converter 100 and a personal audio delivery device 110. The computing device 160 may be, for example, a smartphone, tablet, or laptop computer, a desktop computer, or a server. The personal audio delivery device 110 may take the form of a headset, headphones, earbuds, or hearing aids, among other ear accessories. The binaural converter 100 may be a component of the computing device 160 for converting ambisonic audio to binaural audio.

The computing device 160 may be coupled to the personal audio delivery device 110 via a communication link 112. The communication link 112 may take the form of a wired connection or wireless connection. In some examples, depending on the form of the computing device 160, one or more intermediate devices may facilitate communication between the computing device 160 and the personal audio delivery device 110. For instance, if the computing device 160 is a server, then the computing device 160 may be communicatively coupled to a smartphone via a wired or wireless connection such as a 3rd generation (3G), 4th generation (4G), 5th generation (5G) or WiFi connection and the smartphone may be communicatively coupled to the personal audio delivery device 110 via a Bluetooth connection. Other variations are also possible.

The binaural converter 100 may include an interpolator 102, a head related impulse response (HRIR) mapping function 104, a spherical harmonics converter 106, and a binauralizer 108. The interpolator 102, the HRIR mapping function 104, the spherical harmonics converter 106, and the binauralizer 108 may be implemented in one or more of hardware, software, and/or a combination of hardware and software.

The binaural converter 100 may be arranged to receive HRIRs which characterizes how a pinna of a listener receives sound from sound sources located at various spatial locations. Typically, the pinna receives the sound, directs the sound to an ear canal of the outer ear, which in turn directs the sound to the middle ear. A direction where the sound is coming from is determined based on interactions of the sound with human anatomy. The interaction includes the sound reflecting and/or reverberating and diffracting off a head, shoulder and pinna which generates audio cues which are decoded by the brain to perceive the direction where the sound is coming from. When the listener wears the personal audio delivery device 110, the personal audio delivery device 110 may occlude the pinna preventing spatialization of the sound. For instance, the earcup of the personal audio delivery device 110 may occlude the pinna. The HRIR enables spatializing sound to the listener as if comes from a spatial location, e.g., azimuth, elevation, even though the personal audio delivery device 110 occludes the pinna. The HRIR for the listener may be determined in many ways.

For example, the HRIR may be determined by placing a detector such as one or more microphones in an ear of the listener and detecting how the sound from a sound source at a given spatial location is received at the ear. The HRIR may be a response detected by the microphone as a result of sound being output from the sound source at the given spatial location and indicative of how the sound is received at the ear as the sound reflects and resonates within features of the ear. The sound source may be moved to a plurality of different spatial locations and a respective HRIR determined at each spatial location.

As another example, an HRIR prediction system may predict HRIRs based on anthropometric measurements of the listener's ear, optical measurements of the listener's ear such as an image of a listener's ear, and/or acoustic measurements of how sound reaches the listener's ear. The prediction may be based on a machine learning algorithm which analyze a database of measurements of various ears and associated HRIRs to determine a relationship between the measurements and associated HRIRs. Then, the machine learning algorithm predicts the HRIRs based on the measurements of the listener's ear and the relationship.

A loudspeaker grid may identify discrete sound source locations indicated by cartesian and/or spherical coordinates in a 2 or 3-dimensional grid. The form of the loudspeaker grid may depend on an order of the ambisonic audio to be converted to the binaural audio. For example, the loudspeaker grid may be a bicubic grid, dodecahedron grid, Lebedev grid, among other forms. In some examples, the interpolator 102 may interpolate the HRIRs for a sound source location not on a loudspeaker grid to an HRIR for a sound source location on the loudspeaker grid nearest to the sound source location not on the loudspeaker grid to facilitate converting ambisonic audio to binaural audio. This process is repeated for each of the HRIRs associated with sound source locations not on the loudspeaker grid.

In some examples, the interpolator 102 may not interpolate the HRIRs received by the binaural converter 100 if the HRIRs that is received by the binaural converter 100 are already associated with sound source locations on the loudspeaker grid. For this reason, the interpolator 102 is illustrated as a dotted box to indicate that interpolation by the interpolator 102 may be not performed in some instances.

The spherical harmonics converter 106 may be arranged to receive HRIRs for sound sources located on one side of the head of the listener and convert the HRIRs to spherical harmonics. The spherical harmonics are a complete set of orthogonal functions on a sphere representing the HRIRs. The HRIRs input into the spherical harmonics converter 106 may be organized as HRIR pairs, where each HRIR pair includes a left HRIR associated with a left ear and a right HRIR associated with a right ear and the HRIRs of the HRIR pairs are associated with the sound sources located on one side of the head of the listener. The spherical harmonics converter receives a sequence of HRIRs. The spherical harmonics converter converts the sequence of HRIRs into left spherical harmonics associated with a left ear. Based on a symmetry of sound source locations with respect to the head of the listener, the right HRIRs in the sequence of HRIRs is representative of left HRIRs for sound source locations symmetric to the sound source locations on one side of the head of the listener. Right spherical harmonics associated with the right ear is assumed to be the same as the left spherical harmonics and the left spherical harmonics and the right spherical harmonics are used to binauralize the ambisonic audio.

When HRIRs associated with sound sources located symmetric with respect to the head of the listener are also available, the HRIR mapping function 104 may equivalently map the HRIRs associated with sound sources located symmetric with respect to the head of the listener to the HRIR pairs associated with one side of the head of the listener to determine spherical harmonics. The left HRIR for each HRIR pair associated with sound sources located symmetric with respect to the head of the listener may form left HRIRs and the right HRIRs for each HRIR pair associated with sound sources located symmetric with respect to the head of the listener may form right HRIRs. The left HRIRs and right HRIRs may be each asymmetric in that one or more of the left HRIRs may not be the same as one or more of the right HRIRs and may be each measured, for example. The left and right measured HRIRs are by default asymmetric due to the asymmetric nature of human ears. Each of the left and right measured HRIRs is a true representation of HRIRs and assuming symmetry of the HRIRs may lead to an inaccurate representation of HRIRs. The HRIR mapping function 104 may equivalently map the left HRIRs or the right HRIRs associated with sound sources located symmetric with respect to the head of the listener to HRIR pairs associated with one side of a head of the listener to facilitate conversion of the left HRIRs or right HRIRs to the spherical harmonics.

The HRIRs may be equivalently mapped based on a symmetry of the loudspeaker grid. For example, each HRIR of the left HRIRs may be mapped to a corresponding left HRIR or a corresponding right HRIRs of a corresponding HRIR pair of HRIR pairs associated with sound sources located on one side of the head of the listener. The mapping results in the HRIRs in the HRIR pairs associated with one side of the head of the listener being defined by equivalent left HRIRs associated with the sound sources located symmetric with respect to the head of the listener. As another example, each HRIR of the right HRIRs may be mapped to a corresponding left HRIR or a corresponding right HRIRs of a corresponding HRIR pair of HRIR pairs associated with sound sources located on the one side of the head of the listener. The mapping results in the HRIRs in the HRIR pairs associated with one side of the head of the listener being defined by equivalent right HRIRs associated with the sound sources located symmetric with respect to the head of the listener.

A left sequence of HRIRs based on the mapped left HRIRs or a right sequence of HRIRs based on the mapped right HRIR may be input into the spherical harmonics converter 106 arranged to receive HRIRs for sound sources located on one side of the head of the listener. The spherical harmonics converter 106 may convert the left sequence of HRIRs to left spherical harmonics or convert the right sequence of HRIRs to right spherical harmonics. The spherical harmonics based on HRIRs associated with sound sources located symmetric with respect to the head of the listener improves spatialization of the binaural audio.

A decoder matrix 114 of the spherical harmonic converter 106 may perform the conversion from HRIRs to spherical harmonics. Dimensions of the decoder matrix 114 may be (number of sound source locations in the loudspeaker grid)× (number of channels corresponding to an ambisonic order of the ambisonic audio to binauralize). For example, the decoder matrix dimensions may be 8×4 to convert HRIRs associated with 8 sound source locations of a bicubic loudspeaker grid into 4 channels of spherical harmonics associated with first order ambisonic (FOA) where each channel of the spherical harmonics corresponds to a spherical harmonic. Other variations are also possible.

The binauralizer 108 may also receive the ambisonic audio to binauralize into the binaural audio. The ambisonic audio may be received from a sound server (not shown) which stores the ambisonic audio or the ambisonic audio may be received from a live source of ambisonic audio. The ambisonic audio may also comprise ambisonic signals where each ambisonic signal is associated with a respective channel number of a plurality of channels 1 . . . n. The number of channels of ambisonic audio may match a number of channels of the spherical harmonics. The binauralizer 108 may convert the ambisonic audio into binaural audio based on the left spherical harmonics or the right spherical harmonics. For example, an ambisonic audio signal associated with a channel number of ambisonic audio may be convolved by convolver 116 with an associated channel of the spherical harmonic of the left spherical harmonics. This process is repeated for each channel number. Results of the convolution may be summed by summer 120 to produce a left binaural output. Similarly, an ambisonic audio signal associated with a channel number of ambisonic audio may be convolved by convolver 118 with an associated channel of the spherical harmonic of the right spherical harmonics. This process is repeated for each channel number. Results of the convolution may be summed by summer 122 to produce a right binaural output. In this regard, the binaural audio includes audio cues that spatialize the ambisonic audio for the listener. The computing device 160 provides the left binaural output and right binaural output to the personal audio delivery device 110 via the communication link 112.

Figure 2:
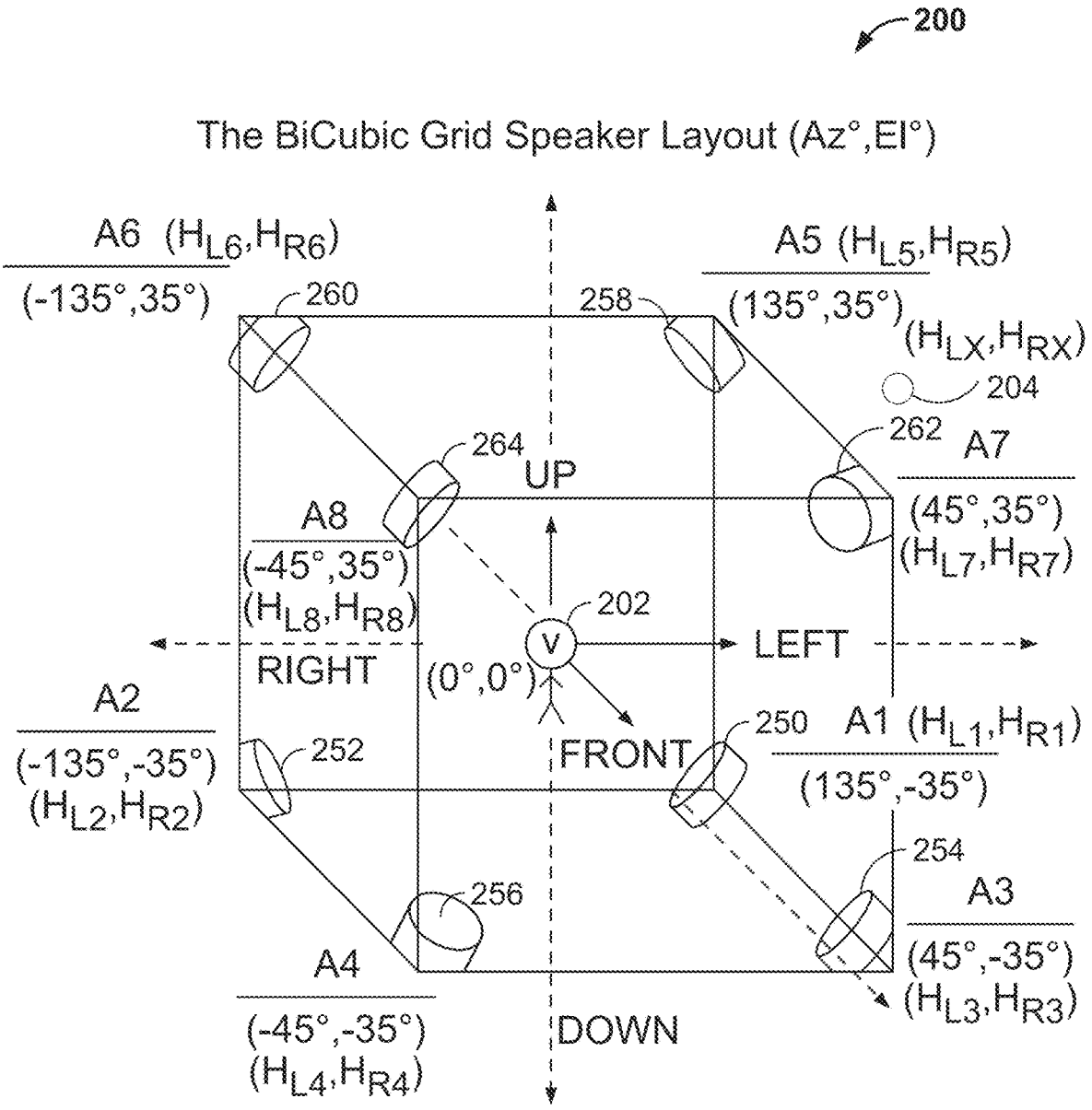
FIG. 2 illustrates example loudspeaker grid angles.

FIG. 2 illustrates an example loudspeaker grid 200. The example loudspeaker grid 200 may be a bicubic grid which defines eight sound source locations A1 to A8 shown as reference numbers 250-264 positioned around a head of the listener located in a center 202 of the bicubic grid. The sound source locations may be identified by angles of elevation (El) and azimuth (Az) in the loudspeaker grid 200, for example, in units of degrees, which are collectively referred to as loudspeaker grid angles. For example, the loudspeaker grid angles for the example loudspeaker grid 200 in the form of the bicubic grid may include the following angles associated with the sound source locations shown in Table 1.

TABLE 1

| Sound Source Location | Azimuth | Elevation |
|---|---|---|
| A1 | 135 deg | −35 deg |
| A2 | −135 deg | −35 deg |
| A3 | 45 deg | −35 deg |
| A4 | −45 deg | −35 deg |
| A5 | 135 deg | 35 deg |
| A6 | 135 deg | −35 deg |
| A7 | 45 deg | 35 deg |
| A8 | −45 deg | 35 deg |

The azimuth and elevation may range from −180<0<180, for example. A positive azimuth angle may correspond to the right side of a head of a listener centered in the loudspeaker grid 200, and a negative azimuth may correspond to the left side of the head of the listener. Further, a positive elevation may correspond to above the head and negative elevation may correspond to positions below the head. Other conventions may be also be used to indicate sides of the head of the listener centered in the loudspeaker grid 200

Each loudspeaker grid angle may be associated with an HRIR pair, referred to as (HLi, HRi) where i corresponds to the loudspeaker grid angle, HL corresponds to the HRIR for a left ear of the listener and HR corresponds to the HRIR for a right ear of the listener. In some examples, an HRIR pair received by the binaural converter 100 may not be associated with a sound source location A1 to A8. To illustrate, HRIR pair may be associated with a sound source location 204 not on the loudspeaker grid 200. The HRIR pair associated with the sound source location 204 may have a left HRIR HLx and right HRIR HRx where x is a loudspeaker grid angle. The interpolator 102 may interpolate the HRIRs of the HRIR pair associated with the sound source location 204 to determine HRIRs for the HRIR pair associated with a sound source location of the loudspeaker grid such as A5. After mapping, each HRIR pair associated with the loudspeaker grid 200 may be associated with a corresponding angle of azimuth and elevation in the loudspeaker grid 200.

Further, symmetry of the loudspeaker grid 200 with respect to the head of the listener lends to having sound source locations which are at a same elevation and different azimuths, where the azimuths are separated by 180 degrees. For example, Angle A1=(135, −35) and Angle A2=(−135, −35) are symmetric counterparts. A1 is a symmetric counterpart to A2 because sound source positions are equally positioned on opposite sides of the head of the listener at a same elevation. Angle A3=(45, −35) and Angle A4=(−45, −35) are symmetric counterparts. A3 is a symmetric counterpart to A4 because sound source positions are equally positioned on opposite sides of the head of the listener at a same elevation. A3 may have a pair of HRIRs: (HL3, HR3) where HL3 is an HRIR for a left ear for A3 and HR3 is an HRIR for a right ear for A3. A4 may have a pair of HRIRs: (HL4, HR4) where HL4 is an HRIR for a left ear for A4 and HR4 is an HRIR for a right ear for A4. Sound source locations at angle A3 of +45 azimuth/−35 elevation and angle A4 of −45 azimuth/−35 elevation (and similarly angle A1 and A2) may have same HRIRs, but swapped for a left and right ear to take advantage of the symmetry of the loudspeaker grid 200, i.e., mirrored HRIR pairs. Based on the symmetry of the loudspeaker grid 200, respective HRIR pairs for each of the loudspeaker angles may be written as follows:

A1. [135 −35]: HL1 HR1

A2. [−135 −35]: HL2 HR2 or HR1 HL1 based on symmetry

A3. [45 −35]: HL3 HR3

A4. [−45 −35]: HL4 HR4 or HR3 HL3 based on symmetry

A5. [135 35]: HL5 HR5

A6, [−135 35]: HL6 HR6 or HR5 HL5 based on symmetry

A7. [45 35]: HL7 HR7

A8. [−45 35]: HL8 HR8 or HR7 HL7 based on symmetry

In examples, HRIRs may be determined for the left and right ear for sound sources located at 4 loudspeaker grid angles on one side of a head of a listener, e.g., for angles A1 [135,−35], A3 [45, −35], A5 [135,35], A7 [45, 35]. This provides 4 HRIR pairs represented as L1R1, L3R3, L5R5 and L7R7. The spherical harmonic converter 106 may receive a sequence of HRIRs based on the 4 HRIR pairs: L1R1 L3R3 L5R5 L7R7 associated with sound sources located on the one side of the head of the listener. Based on a symmetry of the sound source locations with respect to the head of the listener, the right HRIRs is representative of left HRIRs for sound source locations symmetric to the sound source locations on one side of the head of the listener and the sequence of the HRIRs: L1R1 L3R3 L5R5 L7R7 may be equivalent to HL1 HL2 HL3 HL4 HL5 HL6 HL7 HL8. Because of this equivalence, the spherical harmonics converter 106 converts the HRIRs associated with sound source locations on side of the head of the listener into left spherical harmonics associated with a left ear. The right spherical harmonics associated with the right ear may be assumed to be the same as the left spherical harmonics and both the left spherical harmonics and the right spherical harmonics may be used to binauralize the ambisonic audio In examples, the spherical harmonics converter 106 may be further arranged to determine spherical harmonics for HRIRs associated with sound sources locations symmetric with respect to the head of the listener. The spherical harmonics based on HRIRs associated with sound sources located symmetric with respect to the head of the listener improves spatialization of the ambisonic audio.

In examples, HRIR pairs may be determined for sound sources located symmetric with respect to the head of the listener. The left HRIR associated with each pair may be left HRIRs and the right HRIR associated with each pair may be right HRIRs. The left HRIRs and right HRIRs may be mapped to HRIR pairs associated with one side of the head of the listener based on a symmetry of the sound source locations.

For example, the left HRIRs (HL1 to HL8) may be equivalently mapped to the HRIR pairs associated with the sound source locations on one side of the head of the listener. The HRIR mapping function 104 may then output a sequence of HRIRs based on the mapped left HRIRs. The sequence of HRIRs based on the mapped left HRIRs may be ordered by the HRIR mapping function 104 in accordance with symmetry of the loudspeaker grid 200 as:

A1. [135 −35]: HL1, HL2 or HR1 based on symmetry

A3. [45 −35]: HL3, HL4 or HR3 based on symmetry

A5. [135 35]: HL5, HL6 or HR5 based on symmetry

A7. [45 35]: HL7, HL8 or HR7 based on symmetry which makes the sequence output by the HRIR mapping function 104 and input into the spherical harmonic converter 106 as [HL1, HL2, HL3, HL4, HL5, HL6, HL7, HL8]. The mapping of the left HRIRs may include a left HRIR of an HRIR pair associated with a first sound source location being mapped to a right HRIR of an HRIR pair associated with a second sound source location, where two sound source locations are separated by 180 degrees azimuth, but have a same elevation. This mapping process is repeated for each symmetric sound source location. Because HL1 HL2, HL3 HL4, HL5 HL6, HL7 HL8 is equivalent to HL1 HR1, HL3 HR3, HL5 HR5, HL7 HR7, the spherical harmonics converter 106 may then use the sequence of HRIRs based on the mapped left HRIRs and the decoding matrix 114 to determine the left spherical harmonics.

As another example, the right HRIRs (HR1 to HR8) may be equivalently mapped to the HRIR pairs associated with the sound source locations on the one side of the head of the listener. The HRIR mapping function 104 may then output a sequence of HRIRs based on the mapped right HRIRs. The sequence of HRIRs based on the mapped right HRIRs may be ordered by the HRIR mapping function 104 in accordance with symmetry of the loudspeaker grid 200 as:

A1. [135 −35]: HR2 or HL1 based on the symmetry, HR1

A3. [45 −35]: HR4 or HL3 based on the symmetry, HR3

A5. [135 35]: HR6 or HL5 based on the symmetry, HR5

A7. [45 35]: HR8 or HL7 based on the symmetry, HR7 which makes the sequence output by the HRIR mapping function 104 and input into the spherical harmonic converter 106 as [HR2, HR1, HR4, HR3, HR6, HR5, HR8, HR7]. The mapping of the right HRIRs may include a right HRIR of an HRIR pair associated with a first sound source location being mapped to a left HRIR of an HRIR pair associated with a second sound source location, where two sound source locations are separated by 180 degrees azimuth, but have a same elevation. This mapping process is repeated for each symmetric sound source location. Because HR2, HR1, HR4, HR3, HR6, HR5, HR8, HR7 is equivalent to HL1 HR1, HL3 HR3, HL5 HR5, HL7 HR7, the spherical harmonics converter 106 may then use the sequence of HRIRs based on the mapped right HRIRs and the decoding matrix 114 to determine the right spherical harmonics.

The sequence of HRIRs based on the mapped left HRIRs or the sequence of HRIRs based on the mapped right HRIRs may be provided to the spherical harmonics converter 106 arranged to receive HRIRs associated with sound sources located on one side of the head of the listener. Each HRIR in the sequence of HRIRs based on mapped left HRIRs may be associated with an angle A1 to A8 based on the symmetry of the loudspeaker grid 200. Further, each HRIR in the sequence of HRIRs based on mapped right HRIRs may be equivalent to one of the left HRIRs HL1 to HL8 associated with angles A1 to A8 based on the symmetry of the loudspeaker grid 200. Because each sequence is associated with HRIRs for angles A1 to A8, the left spherical harmonics or the right spherical harmonics may be determined for a respective sequence. This equivalence is shown below in Table 2:

TABLE 2

| | FOA Angles | HRIR PAIRS | Left HRIR | Right HRIR | Sequence of Mapped Left HRIRs | Sequence of Mapped Right HRIRs |
|---|---|---|---|---|---|---|
| A1 | (135°, −35°) | ($H_{L1}$ $H_{R1}$) | $H_{L1}$ | $H_{R1}$ | $H_{L1}$ | $H_{R2}$ |
| A2 | (−135°, −35°) | ($H_{L2}$ $H_{R2}$) | $H_{L2}$ | $H_{R2}$ | $H_{L2}$ | $H_{R1}$ |
| A3 | (45°, −35°) | ($H_{L3}$ $H_{R3}$) | $H_{L3}$ | $H_{R3}$ | $H_{L3}$ | $H_{R4}$ |
| A4 | (−45°, 35°) | ($H_{L4}$ $H_{R4}$) | $H_{L4}$ | $H_{R4}$ | $H_{L4}$ | $H_{R3}$ |
| A5 | (135°, 35°) | ($H_{L5}$ $H_{R5}$) | $H_{L5}$ | $H_{R5}$ | $H_{L5}$ | $H_{R6}$ |
| A6 | (−135°, 35°) | ($H_{L6}$ $H_{R6}$) | $H_{L6}$ | $H_{R6}$ | $H_{L6}$ | $H_{R5}$ |
| A7 | (45°, 35°) | ($H_{L7}$ $H_{R7}$) | $H_{L7}$ | $H_{R7}$ | $H_{L7}$ | $H_{R8}$ |
| A8 | (−45°, 35°) | ($H_{L8}$ $H_{R8}$) | $H_{L8}$ | $H_{R8}$ | $H_{L8}$ | $H_{R7}$ |

The spherical harmonics converter 106 may receive the sequence of HRIRs based on the mapped left HRIRs or the sequence of HRIRs based on the right mapped HRIRs. Then, the spherical harmonics converter 106 may apply a decoder matrix 114 to the sequence of HRIRs. The decoder matrix 114 may be derived from mathematical relationships associated with spherical harmonic coefficients and converting a mono sound source to an ambisonic sound field. The decoder matrix 114 may be used to determine the left spherical harmonics and the right spherical harmonics:

$$\text{Left Spherical Harmonics } (hl) = \text{Decoding Matrix}^{Transpose} \times \text{SEQUENCE_OF_HRIRs_BASED_ON_MAPPED LEFT_HRIRs} \quad (1)$$

$$\text{Right Spherical Harmonics } (hr) = \text{Decoding Matrix}^{Transpose} \times \text{SEQUENCE_OF_HRIRs_BASED_ON_MAPPED RIGHT_HRIRs} \quad (2)$$

The spherical harmonics based on HRIRs associated with sound sources located symmetric with respect to the head of the listener improves spatialization of the binaural audio.

Figure 3:
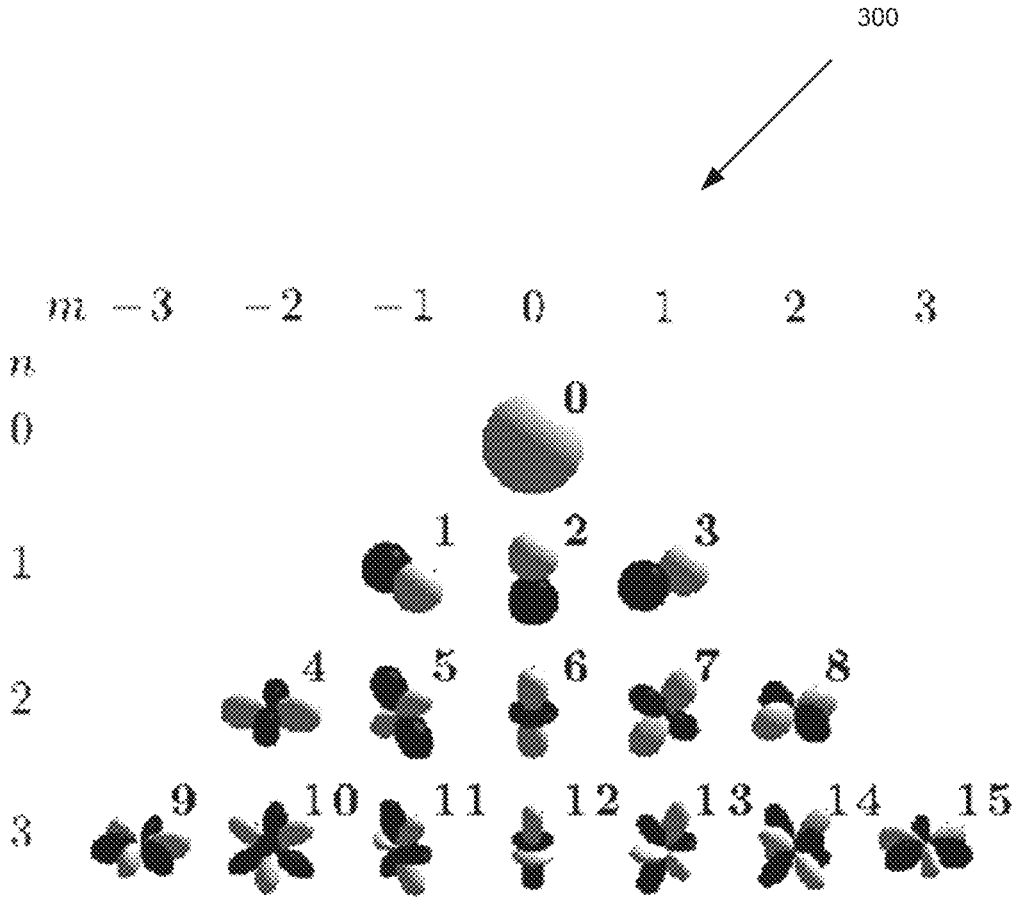
FIG. 3 illustrates example spherical harmonic coefficients.

FIG. 3 illustrates example spherical harmonic coefficients 300 of an ambisonic sound field. The spherical harmonic coefficients may be identified by a combination of m and n, where n is an ambisonic degree and m is an ambisonic order. Spherical harmonic coefficients may be represented as:

$$Y_n^m(\Phi, \theta) = N_n^{|m|} P_n^{|m|}(\sin(\theta)) \begin{cases} \cos(|m|\phi) \text{ if } m \geq 0 \\ \sin(|m|\phi) \text{ if } m \leq 0 \end{cases} \quad (3)$$

where $\phi$ is the source horizontal angle (i.e., azimuth), $\theta$ is the source vertical angle (i.e., elevation), n is the ambisonic order and m is the ambisonic degree. $P_n^{|m|}$ is the associated Legendre's functions. $N_n^{|m|}$ is an SN3D normalization term.

The ambisonic order and degree is computed as:

$$n = \text{floor}(\sqrt{l}) \quad (4)$$

$$m = l - n^2 - n \quad (5)$$

where, l is the ambisonic channel number (ACN). For example, for a first order ambisonic (n=1), the number of channels is 4 derived from the equation $(n+1)^2$. The value of l ranges from 0 to (number-of-channels−1). $0 \leq l \leq 3$ for FOA. The ambisonic degree m defines symmetry of the spherical harmonic coefficient and is defined by the Yn equation above.

To encode a mono sound source 's' into spherical harmonics B, i.e., ambisonic audio, the sound source 's' may be multiplied by the vector y of the spherical harmonic coefficient $$Y_n^{|m|}(\phi,\theta)$$

$$B=s\otimes y \tag{6}$$

Alternatively, the spherical harmonics B may be decoded into the mono sound source 's' by multiplying the spherical harmonics B by the inverse of a loudspeaker re-encoding matrix L. The loudspeaker re-encoding matrix may depend on a type of the loudspeaker grid (bicubic, dodecahedron, etc.) chosen.

$$L=\begin{bmatrix} Y_0^0(\phi_1,\theta_1) & Y_0^0(\phi_i,\theta_i) & \cdots & Y_0^0(\phi_N,\theta_N) \\ Y_1^{-1}(\phi_1,\theta_1) & Y_1^{-1}(\phi_i,\theta_i) & \cdots & Y_1^{-1}(\phi_N,\theta_N) \\ \vdots & \vdots & \vdots & \vdots \\ Y_n^m(\phi_1,\theta_1) & Y_n^m(\phi_i,\theta_i) & \cdots & Y_n^m(\phi_N,\theta_N) \end{bmatrix} \tag{7}$$

Where $\phi_i$, $\theta_i$ are the azimuth and elevation angles of the loudspeaker in the loudspeaker grid. The resultant loudspeaker signals G may be determined by:

$$G=BD \tag{8}$$

$$D=L^T(LL^T)^{-1} \tag{9}$$

where D is the pseudo-inverse of L, which is the loudspeaker re-encoding matrix. D may also be known as the decoder matrix. In this regard, the sequences of HRIRs may be related to spherical harmonics by the decoder matrix and equation G=BD. In order to find the spherical harmonics for the sequences of HRIRs, one takes the inverse of the decoder matrix, which turns out to be a scaled version of its transposed matrix, taken care of in the SN3D normalization and apply equations 1 and 2 above.

The binauralizer 108 may use the left spherical harmonics and the right spherical harmonics to binauralize the ambisonic audio. The binauralization may exploit symmetry of the spherical harmonic coefficients.

Figure 4:
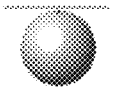
FIG. 4 illustrates example symmetry of the spherical harmonic coefficients.
Figure 4:
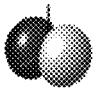
Figure 4:
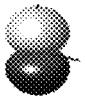
Figure 4:
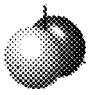

FIG. 4 illustrates a symmetry of spherical harmonic coefficients. The symmetry is illustrated for a first order of the spherical harmonic coefficients 400. Channel number of the spherical harmonic coefficient is identified by column number 402, symmetric axes of the spherical harmonic coefficient is identified by column 404, asymmetric axis of the spherical harmonic coefficient is identified by column 406, and a graphical illustration of the spherical harmonic coefficient is identified by column number 408. For the first order of the spherical harmonic coefficients 400 that is shown, ambisonic channel one has symmetric axes and no anti-symmetric axis, ambisonic channel two has symmetric axes and left/right anti-symmetric axis, ambisonic channel three has symmetric axes and up/down anti-symmetric axis, and ambisonic channel four has symmetric axes and front/back anti-symmetric axis. Based on this symmetry, the binauralizer may calculate the left binaural output and right binaural output as:

$$p_L=\sum_{n=0}^{\infty}\sum_{m=-n}^{n} b_n^m * h_{l,n}^m \tag{10}$$

-continued $$p_R=\sum_{n=0}^{\infty}\sum_{m=-n}^{n}\begin{cases} b_n^m * h_{r,n}^m & \text{if } m\geq 0 \\ -b_n^m * h_{r,n}^m & \text{if } m<0 \end{cases} \tag{11}$$

where $p_L$ and $p_R$ are the left and right binauralized outputs, $b_n^m$ is the ambisonic audio, n is the ambisonic order and m is the ambisonic degree, $h_{l,n}^m$ and $h_{r,n}^m$ are the spherical harmonics associated with the left sequence of HRIRs and right sequence of HRIRs.

For a first order ambisonic, the above equations can be expanded and simplified as follows:

$$p_L=b_0^0 * h_{l,0}^0+b_1^{-1} * h_{l,1}^{-1}+b_1^0 * h_{l,1}^0+b_1^1 * h_{l,1}^1 \tag{12}$$

$$p_R=b_0^0 * h_{r,0}^0+b_1^{-1} * h_{r,1}^{-1}+b_1^0 * h_{r,1}^0+b_1^1 * h_{r,1}^1 \tag{13}$$

The four terms in two $p_L$ and $P_R$ may correspond to the four spherical harmonics (W, X, Y, Z) of the first order ambisonic sound field, e.g., ambisonic channel number 0, 1, 2 and 3. Further, in the equation 12 for the left binaural output, all the terms in the summation are symmetric with respect to the left-right, every ambisonic channel is convolved and then summed to create the left binaural channel. In the equation 13 for the right spatialized binaural output, the first summation contains terms which are symmetric with respect to the left-right axis [Y(0,0), Y(1,0) and Y(1,1)], while the second summation contains terms which are antisymmetric with respect to the left-right axis [Y(1,−1)]. In this regard, every ambisonic channel is convolved and then summed to create the right binaural output, the difference being that the term corresponding to anti-symmetric axis (left-right in this case) has an inverted phase, i.e. the negative sign in the second summation.

The binaural converter 100 may also add reverb to the binaural audio in addition to or instead of spatializing the binaural audio. A room model may define reverb filters analogous to HRIRs for various spatial locations of a sound source. The ambisonic audio may be processed with the reverb filters so that the binaural audio has an identified reverb characterized by a length and gain, in some examples.

Figure 5:
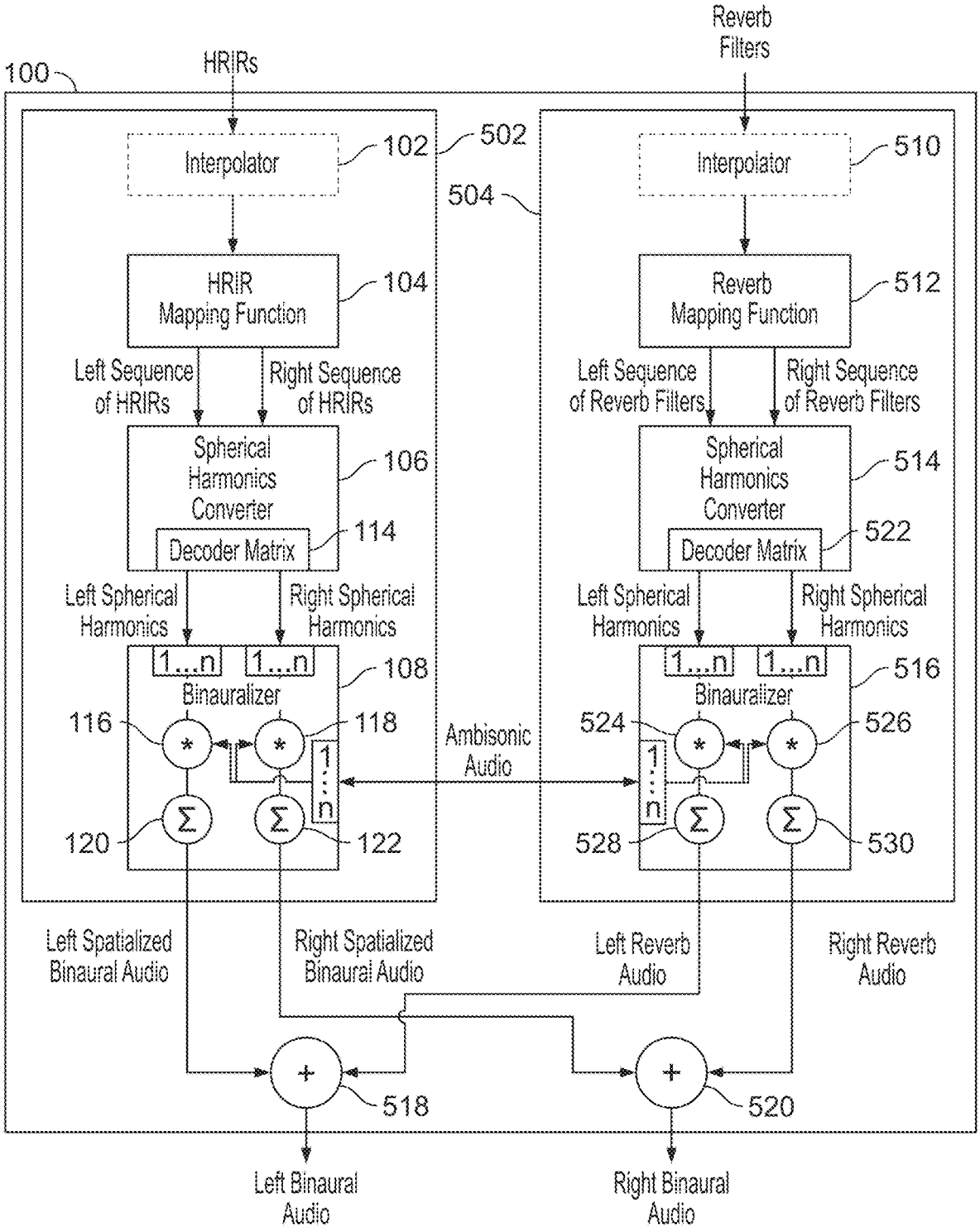
FIG. 5 illustrates another example binaural converter for converting the ambisonic audio to the binaural audio.

FIG. 5 illustrates another example of the binaural converter 100 for converting ambisonic audio into binaural audio. The example binaural converter 100 may have two pipelines 502, 504. The pipeline 502 may correspond to converting ambisonic audio to binaural audio. The pipeline 502 may include the interpolator 102, HRIR mapping function 104, spherical harmonics converter 106, and binauralizer 108 as described above. The pipeline 504 may be associated with adding reverb to the binaural audio. The pipeline 504 may include an interpolator 510, reverb filter mapping function 512, spherical harmonics converter 514, and binauralizer 516.

The interpolator 510 may receive reverb filters for a sound source location not on a loudspeaker grid 200 which is interpolated to determine reverb filters for a sound source location on the loudspeaker grid 200. The reverb filter mapping function 512 may map the reverb filters associated with sound sources located symmetric with respect to the head of the listener to reverb filter pairs associated with one side of the head of the listener. Each reverb filter pair includes a left reverb filter associated with a left ear and a right reverb filter associated with a right ear. The left reverb filter for each pair may form left reverb filters and the right reverb filters for each pair may form right reverb filters. The reverb filters may be mapped based on a symmetry of the loudspeaker grid to the reverb filter pairs associated with one side of the head of the listener. For example, the left reverb filters are mapped to left reverb filters and right reverb filters of reverb filter pairs for the sound source locations on one side of the head of the listener and the right reverb filters are mapped to left reverb filters and right reverb filters of reverb filter pairs for the sound source locations on the one side of the head of the listener.

A left sequence of left reverb filters based on the mapped left reverb filters or a right sequence of right reverb filters based on the mapped right reverb filters may be input into the spherical harmonics converter 514. Based on the symmetry of the loudspeaker grid 200 and the decoder matrix 522, the spherical harmonics converter 514 may determine left spherical harmonics based on the sequence of left reverb filters or right spherical harmonics based on the sequence of right reverb filters. The spherical harmonics based on left reverb filters and right reverb filters associated with sound sources located symmetric with respect to the head of the listener improves reverb of the binaural audio.

An ambisonic audio signal associated with a channel number of ambisonic audio may be convolved by convolver 524 with a left spherical harmonic associated with a same channel number of the left spherical harmonic. This process is repeated for each channel number. Results of the convolution may be summed by summer 528 to produce left reverb audio. An ambisonic audio signal associated with a channel number of ambisonic audio may also be convolved by convolver 526 with a right spherical harmonic associated with a same channel number of the right spherical harmonic. This process is repeated for each channel number. Results of the convolution may be summed by summer 530 to produce right reverb audio. The left reverb audio may be then summed with a left binaural audio by summer 518, and the right reverb audio may be then summed with a right binaural audio by summer 520 to output left binaural audio and right binaural audio which is spatialized and has reverb. The left binaural audio and right binaural audio may be output to the personal audio delivery device 110 to play back audio which is spatialized and has reverb.

The pipelines 502, 504 are shown as separate pipelines for ease of illustration. In some examples, the pipeline 502 for processing HRIRs and the pipeline 504 for processing reverb filters may be a same pipeline with no loss of generality. For example, the same pipeline may receive and process the reverb filters and HRIRs together and/or receive and process the reverb filters and HRIRs sequentially to output the binaural audio with reverb.

Example Operations

Figure 6:
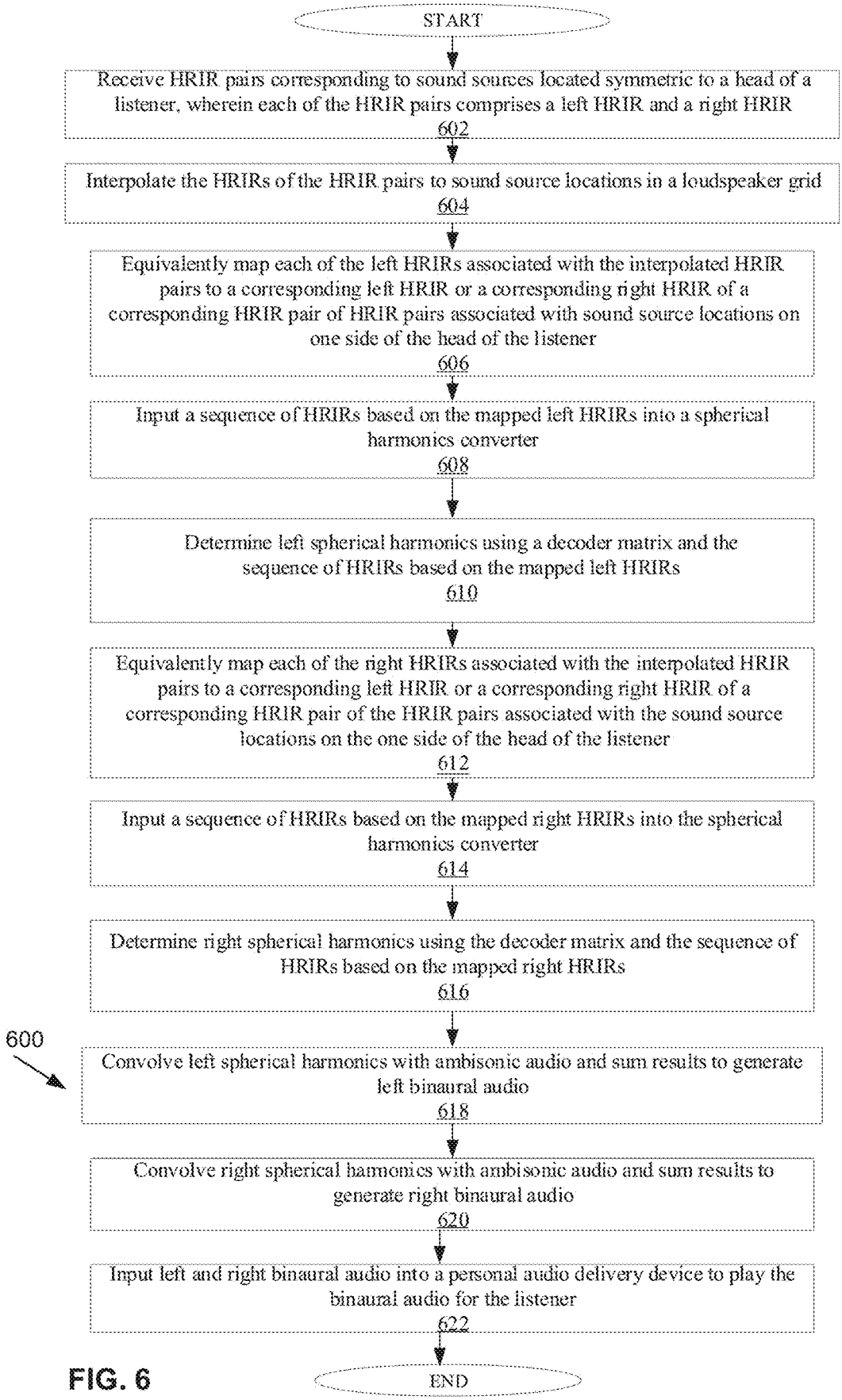
FIG. 6 is an example flow chart of functions associated with converting the ambisonic audio to the binaural audio.

FIG. 6 is an example flow chart of functions 600 associated with converting ambisonic audio into binaural audio. The functions 600 may be performed by the binaural converter 100 and/or personal audio delivery device 110 in one or more of software, hardware, and/or a combination of hardware and software.

At 602, the binaural converter 100 may receive HRIR pairs associated with sound sources located symmetric to a head a listener, where each pair comprises a left HRIR and a right HRIR. The sound sources may be located on sides of the head of a listener similar to that shown in FIG. 2. The left HRIR of an HRIR pair may correspond to an HRIR for a left ear and the right HRIR of the HRIR pair may correspond to an HRIR for a right ear. Further, the HRIRs of the HRIR pairs may correspond to speaker locations symmetric to a head of a listener rather than only HRIRs associated with sound sources on one side of the head of the listener. The left HRIRs and right HRIRs may be each asymmetric in that one or more of the left HRIRs may not be based on one or more of the right HRIRs.

At 604, the binaural converter 100 may interpolate the HRIRs of the HRIR pairs to sound source locations in a loudspeaker grid 200. The interpolator 102 may perform this interpolation. In some examples, this step may not be performed if the HRIR pairs are already associated with sound source locations in the loudspeaker grid 200.

At 606, each of the left HRIRs associated with the interpolated HRIR pairs is equivalently mapped to a corresponding left HRIR or a corresponding right HRIR of a corresponding HRIR pair of HRIR pairs associated with sound source locations on one side of the head of the listener. For example, a left HRIR of an HRIR pair associated with a first sound source is mapped to a right HRIR of an HRIR pair associated with a second sound source, where the first sound source and the second sound source are located at a same elevation and have a difference in azimuth of 180 degrees. The mapping results in the HRIRs in the HRIR pairs associated with one side of the head of the listener being defined by equivalent left HRIRs associated with the sound sources located symmetric with respect to the head of the listener.

At 608, a sequence of HRIRs based on the mapped left HRIRs is input into a spherical harmonics converter 106. For example, the sequence may be HRIRs ordered and associated with angles A1 to A8 indicative of sound source locations.

At 610, a spherical harmonics converter 106 determines left spherical harmonics using a decoder matrix 114 and the sequence of HRIRs based on the mapped left HRIRs. The spherical harmonics converter may be arranged to receive a sequence of HRIRs associated with sound sources located on one side of the head of the listener and determine left spherical harmonics associated with the sequence of HRIRs which is the same as right spherical harmonics. By performing the mapping, the spherical harmonics converter may also determine the left spherical harmonics using a decoder matrix and the sequence of HRIRs based on the mapped left HRIRs which include HRIRs associated with sound source locations symmetric to the head of the listener.

At 612, each of the right HRIRs associated with the interpolated HRIR pairs is equivalently mapped to a corresponding left HRIR or a corresponding right HRIR of a corresponding HRIR pair of the HRIR pairs associated with the sound source locations on the one side of the head of the listener. For example, a right HRIR of an HRIR pair associated with a first sound source is mapped to a left HRIR of an HRIR pair associated with a second sound source, where the first sound source and the second sound source are located at a same elevation and have a difference in azimuth of 180 degrees. The mapping results in the HRIRs in the HRIR pairs associated with one side of the head of the listener being defined by equivalent right HRIRs associated with the sound sources located symmetric with respect to the head of the listener.

At 614, a sequence of HRIRs based on the mapped right HRIRs is input into a spherical harmonics converter 106. For example, the sequence may be HRIRs ordered and associated with angles A1 to A8 indicative of sound source locations.

At 616, the spherical harmonics converter 106 determines right spherical harmonics using the decoder matrix 114 and the sequence of HRIRs based on the mapped right HRIRs. The spherical harmonics converter may be arranged to receive a sequence of HRIRs associated with sound sources located on one side of the head of the listener and determine left spherical harmonics associated with the sequence of HRIRs which is the same as right spherical harmonics. By performing the mapping, the spherical harmonics converter may determine the right spherical harmonics based on decoder matrix 114 and the sequence of HRIRs based on the mapped right HRIRs which include HRIRs associated with sound source locations symmetric to the head of the listener.

At 618, the left spherical harmonics are convolved by a convolver 116 with ambisonic audio and results summed by summer 120 to generate left binaural audio.

At 620, the right spherical harmonics are convolved by a convolver 118 with ambisonic audio and results summed by summer 122 to generate right binaural audio.

At 622, the left and right binaural audio may be input into a personal audio delivery device 110 to play the binaural audio for the listener. In examples, steps similar to steps 602-622 may be performed to add reverb to the binaural audio, where reverb filters are processed instead of HRIRs.

Example Apparatus

Figure 7:
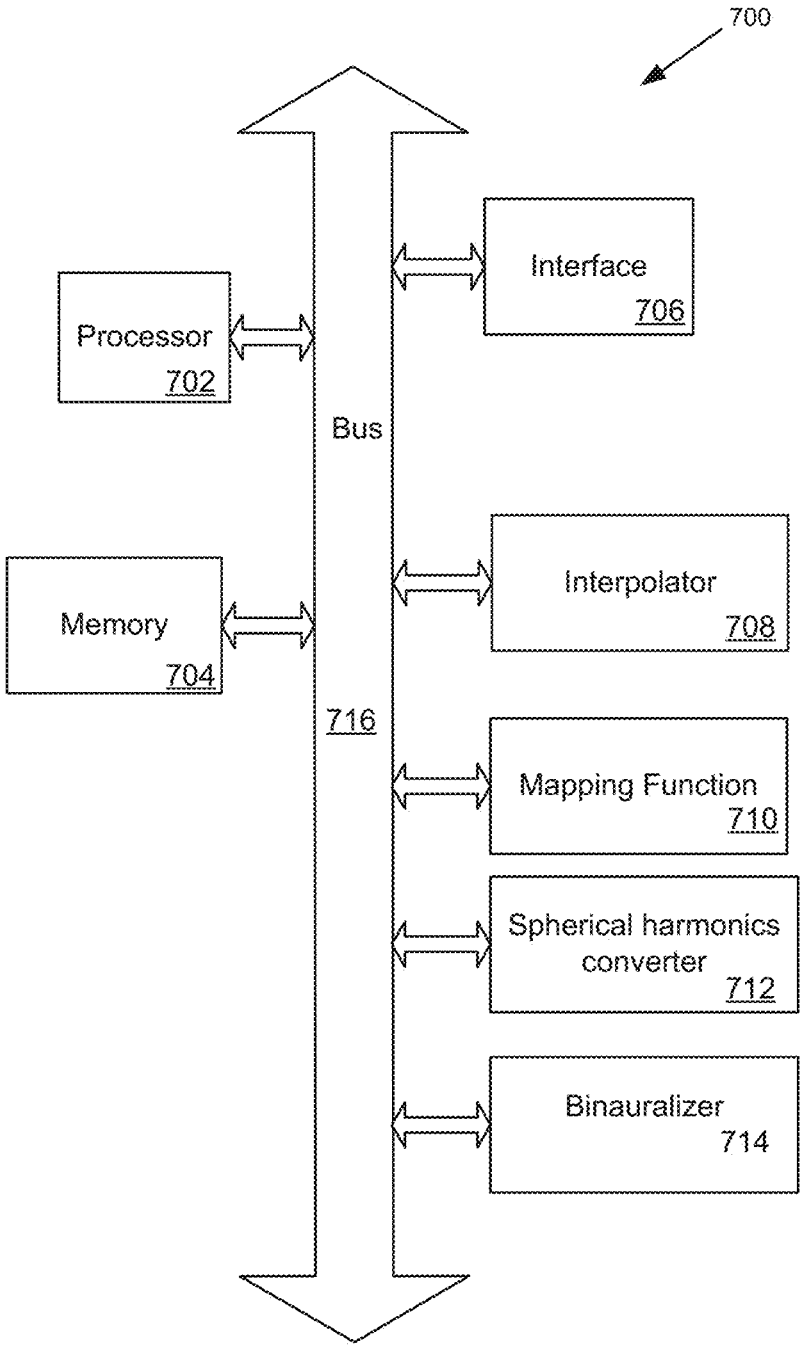
FIG. 7 is an example block diagram of the binaural converter.

FIG. 7 is an example block diagram 700 of the binaural converter 100 for converting spatial audio to binaural audio. The block diagram 700 shows a computer architecture of the binaural converter 100. The block diagram 700 includes a processor 702 (possibly including multiple processors, multiple cores, multiple nodes, and/or implementing multi-threading, etc.) and memory 704 which may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM etc.), a hard disk drive (HDD), solid state drive (SSD) or any one or more other possible realizations of non-transitory machine-readable media/medium. The memory 704 may store, for example, ambisonic audio, HRIRs, and/or reverb filters.

The block diagram 700 further shows an interface 706, interpolator 708, a mapping function 710, spherical harmonics converter 712, and binauralizer 714. The interface 706 may facilitate receiving ambisonic audio, HRIRs, and/or reverb filters. The interpolator 708 may interpolate the HRIRs and/or reverb filters to a loudspeaker grid. The mapping function 710 may map HRIRs associated with sound source locations symmetric to the head of the listener to left HRIRs and right HRIRs of HRIR pairs for the sound source locations on one side of the head of the listener based on a symmetry of a loudspeaker grid 200. The mapping function 710 may also map reverb filters associated with sound source locations symmetric to the head of the listener to left reverb filters and right reverb filters of reverb filter pairs for the sound source locations on one side of the head of the listener based on a symmetry of a loudspeaker grid 200. The spherical harmonics converter 712 may convert a sequence of the HRIRs mapped to the HRIR pairs associated with sound source locations on one side of a head of the listener to spherical harmonics. The spherical harmonics converter 712 may also convert a sequence of the reverb filters mapped to the reverb filter pairs associated with sound source locations on one side of a head of the listener to spherical harmonics. A binauralizer 714 may then convolve the spherical harmonics associated with the HRIRs and/or reverb filters with ambisonic audio and sum results of the convolution to generate the binaural audio which is spatialized and/or has reverb.

The block diagram 700 also includes a bus 716 (e.g., PCI, ISA, PCI-Express, NuBus, etc.). The processor 702, memory 704, interface 706, interpolator 708, mapping function 710, spherical harmonics converter 712, and binauralizer 714 may be coupled to the bus 716. The block diagram 700 may implement any one of the previously described functionalities for outputting the binaural audio partially, (or entirely) in hardware and/or software (e.g., computer code, program instructions, program code, computer instructions) stored on a non-transitory machine readable medium/media. Further, realizations can include fewer or additional components not illustrated in FIG. 7 (e.g., video cards, audio cards, additional network interfaces, peripheral devices, etc.). The processor 702 and the memory 704 are coupled to the bus 716. Although illustrated as being coupled to the bus 716, the memory 704 can be coupled to the processor 702.

The description above discloses, among other things, various example systems, methods, modules, apparatus, and articles of manufacture including, among other components, firmware and/or software executed on hardware. It is understood that such examples are merely illustrative and should not be considered as limiting. For example, it is contemplated that any or all of the firmware, hardware, modules, and/or software aspects or components can be embodied exclusively in hardware, exclusively in software, exclusively in firmware, or in any combination of hardware, software, and/or firmware. Accordingly, the examples provided are not the only way(s) to implement such systems, methods, apparatus, and/or articles of manufacture.

Additionally, references herein to "example" and/or "embodiment" means that a particular feature, structure, or characteristic described in connection with the example and/or embodiment can be included in at least one example and/or embodiment of an invention. The appearances of this phrase in various places in the specification are not necessarily all referring to the same example and/or embodiment, nor are separate or alternative examples and/or embodiments mutually exclusive of other examples and/or embodiments. As such, the example and/or embodiment described herein, explicitly and implicitly understood by one skilled in the art, can be combined with other examples and/or embodiments.

The specification is presented largely in terms of illustrative environments, systems, procedures, steps, logic blocks, processing, and other symbolic representations that directly or indirectly resemble the operations of data processing devices coupled to networks. These process descriptions and representations are typically used by those skilled in the art to most effectively convey the substance of their work to others skilled in the art. Numerous specific details are set forth to provide a thorough understanding of the present disclosure. However, it is understood to those skilled in the art that certain embodiments of the present disclosure can be practiced without certain, specific details. In other instances, well known methods, procedures, components, and circuitry have not been described in detail to avoid unnecessarily obscuring aspects of the embodiments. Accordingly, the scope of the present disclosure is defined by the appended claims rather than the forgoing description of embodiments.

When any of the appended claims are read to cover a purely software and/or firmware implementation, at least one of the elements in at least one example is hereby expressly defined to include a tangible, non-transitory medium such as a memory, DVD, CD, Blu-ray, and so on, storing the software and/or firmware.

Example Embodiments

Example embodiments include the following:

Embodiment 1: A method comprising: receiving first head related impulse responses (HRIRs) pairs corresponding to sound sources located symmetric to a head of a listener, wherein each of the first HRIR pairs comprises a left HRIR and a right HRIR; based on a symmetry of the locations of the sound sources with respect to the head of the listener, equivalently mapping each of the left HRIRs associated with the first HRIR pairs to a left HRIR or right HRIR of second HRIR pairs associated with sound source locations on one side of the head of the listener to form a first sequence of HRIRs; determining left spherical harmonics based on the first sequence of HRIRs and a decoding matrix; based on the symmetry of the sound source locations with respect to the head of the listener, equivalently mapping each of the right HRIRs associated with the first HRIR pairs to the left HRIR or the right HRIR of the second HRIR pairs to form a second sequence of HRIRs; determining right spherical harmonics based on the second sequence of HRIRs and the decoding matrix; and converting ambisonic audio to binaural audio based on the left spherical harmonics and the right spherical harmonics.

Embodiment 2: The method of Embodiment 1, wherein the symmetry of the locations of the sound sources comprises the sound sources being organized as pairs of sound sources, each sound source of the pair of sound sources being located at a same elevation and having a difference in azimuth of 180 degrees Embodiment 3: The method of Embodiment 1 or 2, wherein mapping each of the left HRIRs comprises mapping a left HRIR of an HRIR pair associated with a first sound source to a right HRIR of an HRIR pair associated with a second sound source, wherein the first sound source and the second sound source are located at a same elevation and have a difference in azimuth of 180 degrees.

Embodiment 4: The method of any one of Embodiment 1 to 3, wherein mapping each of the right HRIRs comprises mapping a right HRIR of an HRIR pair associated with a first sound source to a left HRIR of an HRIR pair associated with a second sound source, wherein the first sound source and the second sound source are located at a same elevation and have a difference in azimuth of 180 degrees.

Embodiment 5: The method of any one of Embodiment 1 to 4, further comprising interpolating the left HRIR and the right HRIR of each HRIR pair of the first HRIR pairs to the sound source locations.

Embodiment 6: The method of any one of Embodiment 1 to 5, wherein converting ambisonic audio to binaural audio based on the left spherical harmonics and the right spherical harmonics comprises convolving the ambisonic audio with the left spherical harmonics and the right spherical harmonics to output a respective left binaural output and right binaural output.

Embodiment 7: The method of any one of Embodiment 1 to 6, wherein the left HRIR and right HRIR respectively spatializes sound for a left ear and right ear of the listener.

Embodiment 8: The method of any one of Embodiment 1 to 7, further comprising playing the binaural audio on a personal audio delivery device.

Embodiment 9: The method of any one of Embodiment 1 to 8, wherein the personal audio delivery device is one of a headphone, headset, hearable, earbuds, or hearing aids.

Embodiment 10: A non-transitory, machine-readable medium having instructions stored thereon that are executable by a processor to perform operations comprising: receive first head related impulse responses (HRIRs) pairs corresponding to sound sources located symmetric to a head of a listener, wherein each of the first HRIR pairs comprises a left HRIR and a right HRIR; based on a symmetry of the locations of the sound sources with respect to the head of the listener, equivalently map each of the left HRIRs associated with the first HRIR pairs to a left HRIR or right HRIR of second HRIR pairs associated with sound source locations on one side of the head of the listener to form a first sequence of HRIRs; determine left spherical harmonics based on the first sequence of HRIRs and a decoding matrix; based on the symmetry of the sound source locations with respect to the head of the listener, equivalently map each of the right HRIRs associated with the first HRIR pairs to the left HRIR or the right HRIR of the second HRIR pairs to form a second sequence of HRIRs; determine right spherical harmonics based on the second sequence of HRIRs and the decoding matrix; and convert ambisonic audio to binaural audio based on the left spherical harmonics and the right spherical harmonics.

Embodiment 11: The non-transitory, machine-readable medium of Embodiment 10, wherein the symmetry of the locations of the sound sources comprises the sound sources being organized as pairs of sound sources, each sound source of the pair of sound sources being located at a same elevation and having a difference in azimuth of 180 degrees.

Embodiment 12: The non-transitory, machine-readable medium of Embodiment 10 or 11, wherein the instructions to map each of the left HRIRs comprises instructions to map a left HRIR of an HRIR pair associated with a first sound source to a right HRIR of an HRIR pair associated with a second sound source, wherein the first sound source and the second sound source are located at a same elevation and have a difference in azimuth of 180 degrees.

Embodiment 13: The non-transitory, machine-readable medium of any one of Embodiment 10 to 12, wherein the instructions to map each of the right HRIRs comprises instructions to map a right HRIR of an HRIR pair associated with a first sound source to a left HRIR of an HRIR pair associated with second sound source, wherein the first sound source and the second sound source are located at a same elevation and have a difference in azimuth of 180 degrees.

Embodiment 14: The non-transitory, machine-readable medium of any one of Embodiment 10 to 13, further comprising instructions to interpolate the left HRIR and right HRIR of each HRIR pair of the first HRIR pairs to the sound source locations.

Embodiment 15: The non-transitory, machine-readable medium of any one of Embodiment 10 to 14, wherein the instructions to convert ambisonic audio to binaural audio based on the left spherical harmonics and the right spherical harmonics comprises instructions to convolve the ambisonic audio with the left spherical harmonics and the right spherical harmonics to output a respective left binaural output and right binaural output.

Embodiment 16: The non-transitory, machine-readable medium of any one of Embodiment 10 to 15, wherein the left HRIR and right HRIR respectively spatializes sound for a left ear and right ear of the listener.

Embodiment 17: The non-transitory, machine-readable medium of any one of Embodiment 10 to 16, further instructions to play the binaural audio on a personal audio delivery device.

Embodiment 18: A system comprising: a personal audio delivery device; a non-transitory, machine-readable medium having instructions stored thereon that are executable by a processor to perform operations comprising: receive first head related impulse responses (HRIRs) pairs corresponding to sound sources located symmetric to a head of a listener, wherein each of the first HRIR pairs comprises a left HRIR and a right HRIR; based on a symmetry of the locations of the sound sources with respect to the head of the listener, equivalently map each of the left HRIRs associated with the first HRIR pairs to a left HRIR or right HRIR of second HRIR pairs associated with sound source locations on one side of the head of the listener to form a first sequence of HRIRs; determine left spherical harmonics based on the first sequence of HRIRs and a decoding matrix; based on the symmetry of the sound source locations with respect to the head of the listener, equivalently map each of the right HRIRs associated with the first HRIR pairs to the left HRIR or the right HRIR of the second HRIR pairs to form a second sequence of HRIRs; determine right spherical harmonics based on the second sequence of HRIRs and the decoding matrix; convert ambisonic audio to binaural audio based on the left spherical harmonics and the right spherical harmonics; and play the binaural audio on the personal audio delivery device.

Embodiment 19: The system of Embodiment 18, wherein the symmetry of the locations of the sound sources comprises the sound sources being organized as pairs of sound sources, each sound source of a pair of sound sources being located at a same elevation and having a difference in azimuth of 180 degrees.

Embodiment 20: The system of Embodiment 18 or 19, wherein the instructions to map each of the left HRIRs comprises instructions to map a left HRIR of an HRIR pair associated with a first sound source to a right HRIR of an HRIR pair associated with a second sound source, wherein the first sound source and the second sound source are located at a same elevation and have a difference in azimuth of 180 degrees.

We claim:

1. A method comprising:

receiving a set of head related impulse responses (HRIRs) pairs corresponding to sound sources located symmetric to a head of a listener, wherein each of the HRIR pairs comprises a left HRIR and a right HRIR;

selecting and arranging the left HRIRs from all sound source locations to form a Left Sequence of HRIRs;

selecting and arranging the right HRIRs from all sound source locations to form a Right Sequence of HRIRs;

determining left spherical harmonics based on the Left Sequence of HRIRs and a decoding matrix;

determining right spherical harmonics based on the Right Sequence of HRIRs and the decoding matrix;

converting ambisonic audio to left binaural output using the decoding matrix and the left spherical harmonics;

converting ambisonic audio to right binaural output using the decoding matrix and the right spherical harmonics; and combining the left binaural output and the right binaural output to form a binaural output for playback.

2. The method of claim 1, wherein the symmetry of the locations of the sound sources comprises the sound sources being organized as mirror pairs in azimuth, each sound source and its mirror being located at the same elevation and having a difference in azimuth of 180 degrees.

3. The method of claim 1, wherein the Left Sequence of HRIRs comprises starting with first sound source location in the left hemisphere with respect to the head of the listener as a first angle, selecting the left HRIR from the HRIR pair associated with the first angle;

appending the selected left HRIR to the Left Sequence of HRIRs;

thereby moving to a mirror of the selected sound source in the right hemisphere with respect to the head of the listener as a second angle;

selecting the left HRIR from the HRIR pair associated with the second angle;

appending the selected left HRIR to the Left Sequence of HRIRs; and repeating the process for all sound source locations in the left hemisphere with respect to the head of the listener.

4. The method of claim 1, wherein the Right Sequence of HRIRs comprises starting with a mirror of first sound source location in the right hemisphere with respect to the head of the listener as a first angle, selecting the right HRIR from the HRIR pair associated with the first angle;

appending the selected right HRIR to the Right Sequence of HRIRs;

thereby moving to the selected sound source in the left hemisphere with respect to the head of the listener as a second angle;

selecting the right HRIR from the HRIR pair associated with the second angle;

appending the selected right HRIR to the Right Sequence of HRIRs; and repeating the process for all sound source locations in the left hemisphere with respect to the head of the listener.

5. The method of claim 1, wherein the left spherical harmonics are calculated by multiplying the decoding matrix with the Left Sequence of HRIRs and the right spherical harmonics are calculated by multiplying the decoding matrix with the Right Sequence of HRIRs.

6. The method of claim 1, wherein converting ambisonic audio to binaural output based on the left spherical harmonics and the right spherical harmonics comprises convolving the ambisonic audio with the left spherical harmonics and the right spherical harmonics to output a respective left binaural output and right binaural output.

7. The method of claim 1, wherein the left binaural output and right binaural output respectively spatialize sound for a left ear and right ear of the listener.

8. The method of claim 1, further comprising playing the binaural output on a personal audio delivery device.

9. The method of claim 8, wherein the personal audio delivery device is one of a headphone, headset, hearable, earbuds, or hearing aids.

10. A system comprising:

a binaural converter configured to, receive a set of head related impulse responses (HRIRs) pairs corresponding to sound sources located symmetric to a head of a listener, wherein each of the HRIR pairs comprises a left HRIR and a right HRIR;

select and arrange the left HRIRs from all sound source locations to form a Left Sequence of HRIRs;

select and arrange the right HRIRs from all sound source locations to form a Right Sequence of HRIRs;

determine left spherical harmonics based on the Left Sequence of HRIRs and a decoding matrix;

determine right spherical harmonics based on the Right Sequence of HRIRs and the decoding matrix;

convert ambisonic audio to left binaural output using the decoding matrix and the left spherical harmonics;

convert ambisonic audio to right binaural output using the decoding matrix and the right spherical harmonics; and combine the left binaural output and the right binaural output to form a binaural output for playback.

11. The system of claim 10, wherein the symmetry of the locations of the sound sources comprises the sound sources being organized as mirror pairs in azimuth, each sound source and its mirror being located at the same elevation and having a difference in azimuth of 180 degrees.

12. The system of claim 10, wherein the Left Sequence of HRIRs comprises starting with first sound source location in the left hemisphere with respect to the head of the listener as a first angle, selecting the left HRIR from the HRIR pair associated with the first angle;

appending the selected left HRIR to the Left Sequence of HRIRs;

thereby moving to a mirror of the selected sound source in the right hemisphere with respect to the head of the listener as a second angle;

selecting the left HRIR from the HRIR pair associated with the second angle;

appending the selected left HRIR to the Left Sequence of HRIRs; and repeating the process for all sound source locations in the left hemisphere with respect to the head of the listener.

13. The system of claim 10, wherein the Right Sequence of HRIRs comprises starting with a mirror of first sound source location in the right hemisphere with respect to the head of the listener as a first angle, selecting the right HRIR from the HRIR pair associated with the first angle;

appending the selected right HRIR to the Right Sequence of HRIRs;

thereby moving to the selected sound source in the left hemisphere with respect to the head of the listener as a second angle;

selecting the right HRIR from the HRIR pair associated with the second angle;

appending the selected right HRIR to the Right Sequence of HRIRs; and repeating the process for all sound source locations in the left hemisphere with respect to the head of the listener.

14. The system of claim 10, wherein the left spherical harmonics are calculated by multiplying the decoding matrix with the Left Sequence of HRIRs and the right spherical harmonics are calculated by multiplying the decoding matrix with the Right Sequence of HRIRs.

15. The system of claim 10, wherein converting ambisonic audio to binaural output based on the left spherical harmonics and the right spherical harmonics comprises convolving the ambisonic audio with the left spherical harmonics and the right spherical harmonics to output a respective left binaural output and right binaural output.

16. The system of claim 10, wherein the left binaural output and right binaural output respectively spatialize sound for a left ear and right ear of the listener.

17. The system of claim 10, further comprising a personal audio delivery device configured to play the binaural output.

18. The system of claim 17, wherein the personal audio delivery device is one of a headphone, headset, hearable, earbuds, or hearing aids.

* * * * *